US011926960B2

(12) United States Patent
Warita et al.

(10) Patent No.: US 11,926,960 B2
(45) Date of Patent: Mar. 12, 2024

(54) LEATHER-LIKE SHEET

(71) Applicant: KURARAY CO., LTD., Kurashiki (JP)

(72) Inventors: Masato Warita, Okayama (JP); Michinori Fujisawa, Okayama (JP)

(73) Assignee: KURARAY CO., LTD., Kurashiki (JP)

( * ) Notice: Subject to any disclaimer, the term of this patent is extended or adjusted under 35 U.S.C. 154(b) by 481 days.

(21) Appl. No.: 17/414,975

(22) PCT Filed: Nov. 15, 2019

(86) PCT No.: PCT/JP2019/044896

§ 371 (c)(1),
(2) Date: Jun. 17, 2021

(87) PCT Pub. No.: WO2020/137239

PCT Pub. Date: Jul. 2, 2020

(65) Prior Publication Data

US 2022/0064852 A1 Mar. 3, 2022

(30) Foreign Application Priority Data

Dec. 27, 2018 (JP) ..... 2018-244105

(51) Int. Cl.
*D06N 3/00* (2006.01)

(52) U.S. Cl.
CPC ... *D06N 3/0065* (2013.01); *D06N 2209/0807* (2013.01); *D06N 2209/0876* (2013.01)

(58) Field of Classification Search
CPC ..... D06N 3/0065; D06N 2209/0807; D06N 2209/0876
See application file for complete search history.

(56) References Cited

U.S. PATENT DOCUMENTS

2006/0141228 A1 6/2006 Rearick et al.
2007/0087199 A1* 4/2007 Yoshimura ..... D06N 3/0063 428/411.1
2017/0022659 A1 1/2017 Masaki et al.

FOREIGN PATENT DOCUMENTS

JP 2002255673 A 9/2002
JP 2005320647 A 11/2005
(Continued)

OTHER PUBLICATIONS

International Search Report dated Feb. 18, 2020 in PCT/JP2019/044896 (with English translation), 4 pages.

*Primary Examiner* — Catherine A. Simone
(74) *Attorney, Agent, or Firm* — Element IP, PLC.

(57) ABSTRACT

Disclosed is a leather-like sheet having a surface configured such that, when an L* value, a C* value, and an h value under illumination of a D65 light source are represented as $L^*_{D65}$, $C^*_{D65}$, and $h_{D65}$, and an L* value, a C* value, an h value under illumination of an F10 light source are represented as $L^*_{F10}$, $C^*_{F10}$, and $h_{F10}$, $L^*_{D65}$ is 30 to 95, and at least one selected from a condition $|\Delta C|=|C^*_{F10}-C^*_{D65}|\geq 7$, and a condition $|\Delta h°|=|h_{F10}-h_{D65}|\geq 7°$ is satisfied.

6 Claims, 6 Drawing Sheets

(56) References Cited

FOREIGN PATENT DOCUMENTS

| | | | |
|---|---|---|---|
| JP | 2007239111 | A | 9/2007 |
| JP | 2008525181 | A | 7/2008 |
| JP | 2017193115 | A | 10/2017 |
| WO | WO-2015151873 | | 10/2015 |

* cited by examiner

FDB-001

FDG-005

FDR-002

Example 1

Example 2

Example 3

Example 4

Example 5

Example 6

Comparative Example 1

Comparative Example 2

Comparative Example 3

Comparative Example 4

Comparative Example 5

LEATHER-LIKE SHEET

TECHNICAL FIELD

The present invention relates to an appearance of a leather-like sheet. More particularly, the present invention relates to a leather-like sheet whose color is likely to be perceived as different colors respectively when the leather-like sheet is irradiated with light from light sources such as sunlight, a fluorescent lamp, and an incandescent lamp.

BACKGROUND ART

Leather-like sheets such as an artificial leather resembling a natural leather are known as the skin materials of bags, clothing, shoes, and the like. Specifically, for example, a grain-finished leather-like sheet including a fiber base material, and a resin layer stacked on the fiber base material, and a napped artificial leather having a napped surface formed by napping fibers on a surface layer of a fiber base material are known.

Color rendering is known as a property that makes the color appearance of the same object different depending on the wavelength spectrum of the light with which the object is illuminated. For example, color rendering is a property that allows the color of an object to be perceived by a person as different colors when the object is illuminated by sunlight and when the object is illuminated by a white fluorescent lamp, even if they both are white light sources. In general, an object having low dependence on the type of the light source, or in other words, an object whose color perceived by a person is less likely to change even when the type of the light source is changed, is evaluated as exhibiting good color rendering.

As a leather-like sheet exhibiting good color rendering, for example, PTL 1 listed below discloses a suede-like artificial leather that has, on a surface thereof, suede-like naps made of ultrafine polyester fibers of 0.3 dtex or less, and that has been dyed using five or more types of dyes, wherein a color difference ΔE between colors provided by an F6 light source and a D65 light source, as measured on the surface having the suede-like naps, is 1.2 or less. Also, PTL 1 discloses that such a suede-like artificial leather has a small difference between the appearance of its color seen under a standard light source (sunlight source) and the appearance of its color seen under a white fluorescent lamp light source.

As an object that changes color, for example, PTL 2 listed below discloses a color rendering ceramic product produced by forming, into a predetermined shape, a ceramic raw material containing fine particles of at least one rare-earth element oxide selected from holmium, praseodymium, neodymium, and erbium, and thereafter sintering the raw material, wherein the object reversibly changes color according to the type of an external light source.

CITATION LIST

Patent Literatures

[PTL 1] Japanese Laid-Open Patent Publication No. 2007-239111

[PTL 2] Japanese Laid-Open Patent Publication No. 2002-255673

SUMMARY OF INVENTION

Technical Problem

The leather-like sheet, disclosed in PTL 1, exhibiting good color rendering, whose color perceived by a person is less likely to change even when the type of the light source is changed, has been known. On the other hand, there has been no known leather-like sheet that has an excellent design quality and whose color perceived by a person significantly changes when the type of the light source is changed. Furthermore, with the technique disclosed in PTL 2, it is difficult to color the leather-like sheet.

It is an object of the present invention is to provide a leather-like sheet that has a novel design quality and whose color is perceived as colors significantly different from each other between a case where illumination of a D65 light source, which represents sunlight, is used, and a case where illumination of an F10 light source, which represents three-wavelength neutral white of a fluorescent lamp, is used.

Solution to Problem

As a method for specifying color of an object, tristimulus values XYZ defined by the International Commission on Illumination (CIE) that are based on the color mixing theory of the three primary colors (RGB) of light are widely adopted. X represents a red component (R), Y represents a green component (G), and Z represents a blue component (B). The larger the value of each of the components, the larger the mixed amount thereof indicated. The tristimulus values XYZ can be obtained by integrating the product of each of the color matching functions ($x(\lambda)$, $y(\lambda)$, $z(\lambda)$), the spectral distribution $S(\lambda)$ of illumination light, and the spectral reflectance $R(\lambda)$ of an object for the wavelength. The color matching functions ($x(\lambda)$, $y(\lambda)$, $z(\lambda)$) represent the response characteristics (spectral responsivities) of the cones to red, green, and blue components of light when a human eye receives light. In the International Commission on Illumination (CIE), the color matching functions for a 2° field of view and a 10° field of view are adopted (see FIGS. 4A and 4B).

For the spectral distribution $S(\lambda)$ of illumination light, for example, in JIS Z 8720:2012 "Standard illuminants (standard light) and sources for colorimetry", in addition to a standard light A and a D65 standard light source, auxiliary illuminants such as F6, F8, and F10 are prescribed (see FIGS. 5A and 5B). D65 is a light source representing daylight-color having a correlation color temperature of 6504 K, F10 is a light source representing three-wavelength neutral white of a widely used fluorescent lamp and having a correlation color temperature of 5000 K, and both represent white light. In general, F10 is a high color rendering light source, and is less likely to exhibit a color difference from the D65 light source compared with the F6 light source. The present invention is directed to a leather-like sheet whose color perceived when illumination of a D65 light source is used is significantly different from its color perceived when a high color rendering light source F10 exhibiting higher color rendering than an F6 light source is used.

The product of each of the color matching functions ($x(\lambda)$, $y(\lambda)$, $z(\lambda)$) and the spectral distribution $S(\lambda)$ of the illumination light is called a pre-calculated weighting function to the spectral reflectance $R(\lambda)$ of an object. FIGS. 2A, 2B and 2C show pre-calculated weighting functions of the D65 light source and the F10 light source.

When a predetermined spectral distribution $S(\lambda)$ of illumination light is used, the tristimulus values XYZ of an object can be determined by integrating the product of the pre-calculated weighting functions and the spectral reflectance $R(\lambda)$ to a color of each object for the wavelength. That is, by multiplying each of the pre-calculated weighting functions by the spectral reflectance R(λ), and further integrating the result for the wavelength, tristimulus values XYZ can be obtained that represent a color perceived by a person as a result of the light having been reflected by the object surface under illumination light having a predetermined spectral distribution S(λ). In general, good color rendering means a property that a color perceived by a person is less likely to change regardless of the spectral distribution S(λ) of illumination light, and poor color rendering means a property that a color perceived by a person is likely to change depending on the spectral distribution S(λ) of the illumination light.

As a result of investigating the spectra of the pre-calculated weighting functions, which are the products of the color matching functions (x(λ), y(λ), z(λ)) and the spectral distribution S(λ) of illumination light, and adjusting the spectral reflectance R(λ) of an object, the present inventors have found a use of means by which tristimulus values XYZ changes when the spectral distribution $S(\lambda)_{D65}$ of the D65 light source, which represents sunlight, is changed to the spectral distribution $S(\lambda)_{F10}$ of the F10 light source, which represents three-wavelength neutral white of a fluorescent lamp, and a color perceived by a person is significantly changed.

That is, an aspect of the present invention is directed to a leather-like sheet having a surface configured such that, when an L* value, a C* value, and an h value under illumination of a D65 light source are represented as $L^*_{D65}$, $C^*_{D65}$, and $h_{D65}$, and an L* value, a C* value, an h value under illumination of an F10 light source are represented as $L^*_{F10}$, $C^*_{F10}$, and $h_{F10}$, $L^*_{D65}$ is 30 to 95, and at least one selected from a condition $|\Delta C|=C^*_{F10}-C^*_{D65}|\geq 7$, and a condition $|\Delta h°|=|h_{F10}-h_{D65}|\geq 7°$ is satisfied. When the leather-like sheet has a surface configured such that $L^*_{D65}$ is 30 to 95, and at least one selected from a condition $|\Delta C|=|C^*_{F10}-C^*_{D65}|\geq 7$, and a condition $|\Delta h°|=|h_{F10}-h_{D65}|\geq 7°$ is satisfied, a change in color of the leather-like sheet can be clearly identified when the light source is changed.

It is preferable that the leather-like sheet has the surface configured such that, when a maximum reflectivity of a spectral reflectance R(λ) in each of wavelength ranges of 520 to 540 nm, 550 to 570 nm, and 590 to 610 nm is represented as $R_{max}$, and a minimum reflectivity is represented as $R_{min}$, $(1-R_{max})/(1-R_{min})\leq 0.8$ is satisfied in at least one of the wavelength regions. This is preferable because the tristimulus values XYZ calculated from the integral value of the product of the spectral reflectance R(λ) and each of the pre-calculated weighting functions for the wavelength changes between a case where the leather-like sheet is illuminated by the D65 light source, and a case where the leather-like sheet is illuminated by the F10 light source, so that a surface configured such that at least one selected from a condition $|\Delta C|=C^*_{F10}-C^*_{D65}|\geq 7$, and a condition $|\Delta h°|=|h_{F10}-h_{D65}|7°$ is satisfied can be more easily obtained.

It is preferable that the leather-like sheet is a grain-finished leather-like sheet including a surface resin layer, and that a color filter colorant is included in the surface resin layer, because this makes it possible to more easily obtain the above-described grain-finished leather-like sheet in which the color of the surface resin layer changes.

It is preferable that a napped leather-like sheet includes a fiber base material, and has a nappe surface, and that a color filter colorant is included in the fiber base material, because this makes it possible to more easily obtain a napped leather-like sheet in which the color of the napped surface changes.

Advantageous Effects of Invention

According to the present invention, it is possible to obtain a leather-like sheet that has a novel design quality and whose color is perceived as colors significantly different from each other between a case where illumination of a D65 light source, which represents sunlight, is used, and a case where illumination of an F10 light source, which represents three-wavelength neutral white of a fluorescent lamp, is used.

DESCRIPTION OF EMBODIMENT

Figure 1:
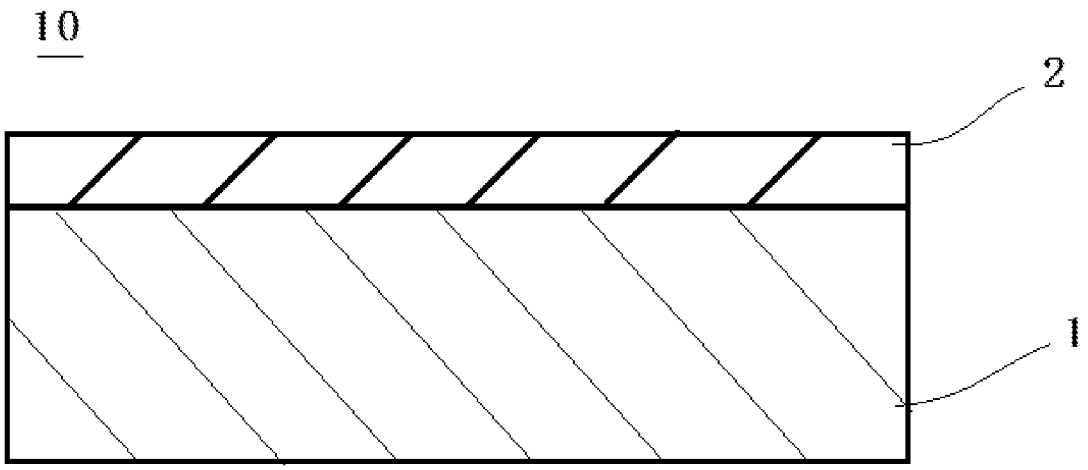
FIG. 1 is a schematic cross-sectional view of a grain-finished artificial leather according to an embodiment.

First, an L* value, a C* value, and an h value will be described. The L* value, the C* value, and the h value respectively represent the lightness, the chroma, and the hue angle prescribed in JIS Z 8781-4:2013 "Colorimetry-Part 4: CIE1976 L*a*b* color space", and are respectively defined as a CIE1976 lightness, a CIELAB1976 a,b chroma, and a CIELAB1976 a,b hue-angle. The L*C*h color system is converted from the chromaticity (L*, a*, b*) of the L*a*b* color system. The chromaticity according to the L*a*b* color system can be measured with a spectrophotometer.

The lightness L* value is a lightness L* value of the L*a*b* color system. The chroma C* value is obtained from the values of a* and b* of the L*a*b* color system, using the expression: $C^*=[(a^*)^2+(b^*)^2]^{1/2}$. The hue angle h value is obtained using the expression: $h=\tan^{-1}[(b^*)/(a^*)]$.

The lightness L* value is represented in the range of 0 (dark) to 99 (light). The chroma C* value is represented in the range of 0 (dull) to 99 (vivid). The h value (hue angle) is represented in the range of 0 to 360°; for example, the range of 0 to 59° represents the range of red to yellow, the range of 60 to 119° represents the range of yellow to green, the range of 120 to 179° represents the range of green to light blue, the range of 180 to 239° represents the range of light blue to blue, the range of 240 to 299° represents the range of blue to purple, and the range of 300 to 360° represents the range of purple to red.

The leather-like sheet according to the present embodiment has a surface configured such that, when an L* value, a C* value, and an h value under illumination of a D65 light source are represented as $L^*_{D65}$, $C^*_{D65}$, and $h_{D65}$, and an L* value, a C* value, an h value under illumination of an F10 light source are represented as $L^*_{F10}$, $C^*_{F10}$, and $h_{F10}$, $L^*_{D65}$ is 30 to 95, and at least one selected from a condition $|\Delta C|=|C^*_{F10}-C^*_{D65}|\geq 7$, and a condition $|\Delta h°|=|h_{F10}-h_{D65}|\geq 7°$ is satisfied.

The chromaticity (L*, b*) according to the L*a*b* color system of an object changes depending on the spectral distribution S(λ) of the light source. The leather-like sheet according to the present embodiment is adjusted to obtain a surface configured such that $L^*_{D65}$ is 30 to 95, and at least one selected from a condition $|\Delta C|=|C^*_{F10}-C^*_{D65}|\geq 7$, and a condition $|\Delta h°|=|h_{F10}-h_{D65}|\geq 7°$) is satisfied, when a D65 light source exhibiting a spectral distribution $S(\lambda)_{D65}$ is selected to measure the chromaticity ($L^*_{D65}$, $a^*_{D65}$, $b^*_{D65}$) according to the L*a*b* color system, an F10 light source exhibiting a spectral distribution $S(\lambda)_{F10}$ is selected to measure the chromaticity ($L^*_{F10}$, $a^*_{F10}b^*_{F10}$) according to the L*a*b* color system, and each of the measured values are converted into values in the L*C*h color system to calculate ($L^*_{D65}$, $C^*_{D65}$, $h_{D65}$) and ($L^*_{F10}$, $C^*_{F10}$, $h_{F10}$). With the leather-like sheet having such a surface, it is possible to obtain a leather-like sheet whose color perceived by a person significantly changes between a case where the leather-like sheet is seen under sunlight, and a case where the leather-like sheet is seen under white fluorescent lamp.

The surface of the leather-like sheet according to the present embodiment is configured such that $L^*_{D65}$ is 30 to 95, preferably 33 to 93, and more preferably 35 to 90. When the $L^*_{D65}$ is in such a range, a change in chroma and hue between a case where the D65 light source is selected and a case where the F10 light source is selected is likely to be perceived. When $L^*_{D65}$ exceeds 95, the surface becomes too bright for a person to clearly perceive a change in color. When $L^*_{D65}$ is less than 30, the surface becomes too dark for a person to clearly perceive a change in color.

The surface of the leather-like sheet according to the present embodiment is configured such that $|\Delta C|=|C^*_{F}10-C^*_{D65}|\geq 7$, more preferably $|\Delta C|\geq 10$, and particularly preferably $|\Delta C|\geq 12$. When $|\Delta C|$ is in such a range, the chroma changes between a case where the D65 light source is selected and a case where the F10 light source is selected, whereby it is possible to allow a person to clearly perceive a change in color.

The surface of the leather-like sheet according to the present embodiment is configured such that preferably $|\Delta h°|=|h_{F10}-h_{D65}|\geq 7°$, more preferably $|\Delta h°|10°$, and particularly preferably $|\Delta h°|12°$. When $|\Delta h°|$ is in such a range, the hue changes between a case where the D65 light source is selected and a case where the F10 light source is selected, whereby it is possible to allow a person to clearly perceive a change in color.

The surface of the leather-like sheet according to the present embodiment preferably exhibits a relatively large color difference $\Delta E_{CMC}$ due to tristimulus values XYZ changing between the D65 light source and the F10 light source. Specifically, for example, it is preferable that $\Delta E_{CMC}\geq 4$, it is more preferable that $\Delta E_{CMC}\geq 5$, and it is particularly preferable that $\Delta E_{CMC}\geq 8$. Note that the color difference $\Delta E_{CMC}$ is represented by the color difference formula CMC (l:c) described in JIS Z 8730:2009 "Color specification-Color differences of object colors" Annex A A.2, and l=c=1.

In the present invention, the leather-like sheet is a pseudo leather such as an artificial leather and a synthetic leather. The surface of the pseudo leather may be a grain-finished leather-like sheet formed by stacking a grain-finished surface resin layer on the surface of a fiber base material, or may be a suede-like or nubuck-like napped leather-like sheet formed by raising fibers on the surface of a fiber base material. Also, in the leather-like sheet according to the present invention, the spectral reflectance R(λ) of the surface of the leather-like sheet is adjusted by including a coloring material in the surface resin layer of the grain-finished leather-like sheet or in the napped surface of the napped grain-finished leather-like sheet when coloring them. Also, the above-described leather-like sheet having a surface configured such that $L^*_{D65}$ is 30 to 95, and at least one selected from a condition $|\Delta C|=|C^*_{F10}-C^*_{D65}|\geq 7$, and a condition $|\Delta h°|=|h_{F10}-h_{D65}|\geq 7°$ is satisfied is produced.

As an example, FIG. 1 is a schematic cross-sectional view illustrating a layer configuration of a grain-finished artificial leather 10, which is a grain-finished leather-like sheet. The grain-finished artificial leather 10 includes a fiber base material 1, and a resin layer 2 stacked on the fiber base material 1.

The spectral reflectance R(λ) of the surface of the resin layer 2 is adjusted by including a coloring material described below in the resin layer 2. The resin layer 2 may be a single layer, or may be a layer composed of a plurality of layers, for example, including a resin skin layer, a resin intermediate layer, and an adhesion layer. The thickness of the resin layer 2 is not particularly limited, but is, for example, preferably about 10 to 300 μm, and more preferably about 30 to 200 μm. The resin layer 2 may be of a foamed or unfoamed material, or may be a combination thereof. As the resin for forming the resin layer 2, any of conventionally known resins such as various elastic polymers including, for example, a polyurethane, used for forming a grain surface of an artificial leather and a synthetic leather can be used without any particular limitation.

As the fiber base material 1, any conventionally known fiber base material used for an artificial leather and a synthetic leather, such as a non-woven fabric, a woven fabric, a knitted fabric, or a base material formed by impregnating an elastic polymer such as a polyurethane into these fabrics, can be used without any particular limitation. The thickness of the fiber base material is also not particularly limited, but is, for example, preferably about 300 to 3000 μm, and more preferably about 500 to 1500 μm. The type of the fibers that form the fiber base material is also not particularly limited; for example, nylon-based fibers, polyester-based fibers, polyolefin-based fibers, polyurethane-based fibers, and the like can be used without any particular limitation. The fineness of the fibers that form the fiber base material is also not particularly limited.

As the coloring material for adjusting the spectral reflectance R(λ), a coloring material that can adjust the color of the surface such that $L^*_{D65}$ is 30 to 95, and at least one selected from a condition $|\Delta C|=|C^*_{F10}-C^*_{D65}|\geq 7$, and a condition $|\Delta h°|=|h_{F10}-h_{D65}|\geq 7°$ is satisfied by changing the tristimulus values XYZ obtained from integral value of the product of each of the pre-calculated weighting functions (X, Y, Z) and the spectral reflectance R(λ) for the wavelength, between a case where the D65 light source is selected and a case where the F10 light source is selected. In the following, this will be described in detail with reference to FIGS. 2A, 2B and 2C.

Figure 2A:
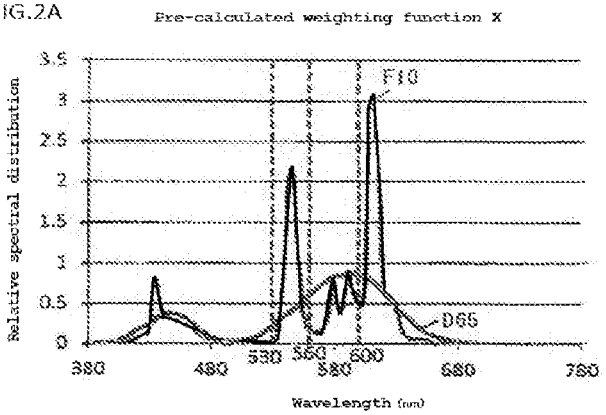
FIGS. 2A, 2B and 2C, respectively, show pre-calculated weighting functions of a D65 light source and an F10 light source.

For the pre-calculated weighting function X in FIG. 2A, which affects the redness X of the tristimulus values XYZ, the D65 light source has broad continuous peaks, one each in the range of about 400 to 490 nm, and the range of about 520 to 690 nm. On the other hand, the F10 light source has one peak having a peak top at about 450 nm, and four discontinuous peaks having peak tops at about 540 nm, about 580 nm, about 590 nm, and about 620 nm, respectively.

Figure 2B:
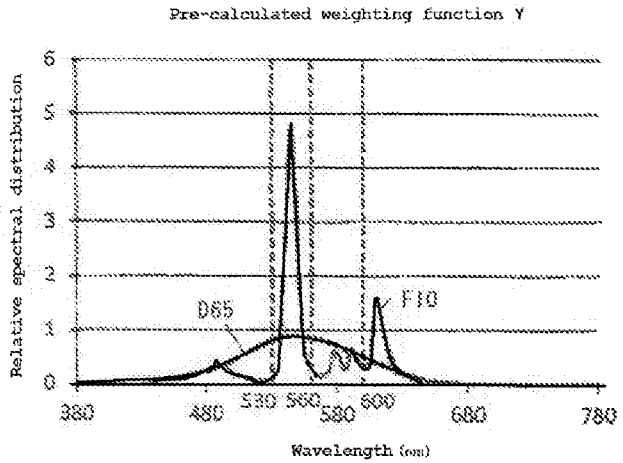

For the pre-calculated weighting function Y in FIG. 2B, which affects the greenness Y of the tristimulus values XYZ, the D65 light source has one broad continuous peak in the range of about 430 to 680 nm. On the other hand, the F10 light source has one peak having a peak top at about 485 nm in a first region, and four discontinuous peaks having peak tops at about 540 nm, about 580 nm, about 590 nm, and about 620 nm, respectively.

Figure 2C:
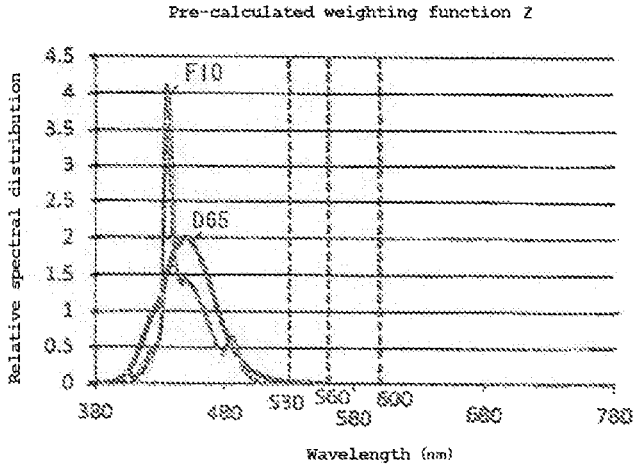

For the pre-calculated weighting function Z in FIG. 2C, which affects the blueness Z of the tristimulus values XYZ, the D65 light source has a broad continuous peak with a maximum at about 460 nm. On the other hand, the F10 light source has a peak having a peak top at about 450 nm and a shoulder at about 460 nm.

As described above, the tristimulus values XYZ can be obtained by integrating the product of each of the pre-calculated weighting functions (X, Y, Z) and the spectral reflectance R(λ) for the wavelength. Accordingly, if the spectral reflectance R(λ) by which each of the peaks of the pre-calculated weighting functions (X, Y, Z) is multiplied changes, the integral value of the product of the pre-calculated weighting functions (X, Y, Z) and the spectral reflectance R(λ) for the wavelength changes. In particular, the pre-calculated weighting function X and the pre-calculated weighting function Y have significantly different spectrum shapes between the D65 light source and the F10 light source as compared with the pre-calculated weighting function Z, and it is therefore possible to significantly change the degree of contribution of each of the peaks of the pre-calculated weighting functions X and the pre-calculated weighting functions Y by adjusting the peak shape and the peak wavelength of the spectral reflectance R(λ) by which each of the peaks is multiplied. As a result, it is possible to significantly change the integral value of the product of each of the pre-calculated weighting functions (X, Y) and the spectral reflectance R(λ) of the wavelength.

Specifically, the pre-calculated weighting function X of the D65 light source and the pre-calculated weighting function X of the F10 light source will be compared with reference to FIG. 2A. Near 530 nm, which is near the peak start of the peak having a peak top at 540 nm, near 560 nm, which is near the peak end of the peak having a peak top at 540 nm, or near 600 nm, which is the valley between the peak having a peak top at 590 nm and the peak having a peak top at 620 nm, of the F10 light source, all of which overlap the broad continuous peak of the D65 light source, the relative spectral distribution of D65 is significantly larger than the relative spectral distribution of F10. Accordingly, when the spectral reflectance R(λ) is to be multiplied is adjusted to be increased in these wavelength regions in which the relative spectral distribution of D65 is significantly larger than the relative spectral distribution of F10, the integrated value of the product of the pre-calculated weighting function X of the D65 light source and the spectral reflectance R(λ) for the wavelength is likely to be increased relative to the integrated value of the product of the pre-calculated weighting function X of the F10 light source and the spectral reflectance R(λ) for the wavelength. As a result, when the D65 light source and the F10 light source are switched with each other, X, which is the integral value of the product of the pre-calculated weighting functions X and the spectral reflectance R(λ) for the wavelength, of the tristimulus values significantly changes.

Similarly, the pre-calculated weighting function Y of the D65 light source and the pre-calculated weighting function Y of the F10 light source will be compared with reference to FIG. 2B. At a wavelength near 530 nm, which is near the peak start of the peak having a peak top at 540 nm, near 560 nm, which is near the peak end of the peak having a peak top at 540 nm, or near 600 nm, which is the valley between the peak having a peak top at 590 nm and the peak having a peak top at 620 nm, of the F10 light source, all of which overlap the broad continuous peak of the D65 light source, the relative spectral intensity of D65 is significantly larger than the relative spectral intensity of F10. Accordingly, when the spectral reflectance R(λ) is to be multiplied is adjusted to be increased in these wavelength regions in which the relative spectral distribution of D65 is significantly larger than the relative spectral distribution of F10, the integrated value of the product of the pre-calculated weighting functions Y of the D65 light source and the spectral reflectance R(λ) for the wavelength is likely to be increased relative to the integrated value of the product of the pre-calculated weighting functions Y of the F10 light source and the spectral reflectance R(λ) for the wavelength. As a result, when the D65 light source and the F10 light source are switched with each other, Y, which is the integral value of the product of the pre-calculated weighting functions Y and the spectral reflectance R(λ) for the wavelength, of the tristimulus values significantly changes.

As described above, by adjusting the spectral reflectance R(λ) of the surface of the resin layer, it is possible to adjust the color such that $L^*_{D65}$ is 30 to 95, and at least one selected from a condition $|\Delta C|=|C^*_{F10}-C^*_{D65}|\geq 7$, and a condition $|\Delta h°|=|h_{F10}-h_{D65}|\geq 7°$ is satisfied.

Preferably, such a spectral reflectance R(λ) is adjusted such that the leather-like sheet has a surface configured such that, when a maximum reflectivity in each of the wavelength ranges near 530 nm (520 to 540 nm), which is near the peak start of the peak having a peak top at 540 nm of the F10 light source, near 560 nm (550 to 570 nm), which is near the peak end of the peak having a peak top at 540 nm of the F10 light source, and near 600 nm (590 to 610 nm), which is the valley between the peak having a peak top at 590 nm and the peak having a peak top at 620 nm, is represented as $R_{max}$, and a minimum reflectivity is represented as $R_{min}$, preferably $(1-R_{max})/(1-R_{min})\geq 0.8$, and more preferably $(1-R_{max})/(1-R_{min})\leq 0.7$ is satisfied in at least one of the wavelength ranges, because the integral value of a product obtained by multiplying the pre-calculated weighting function by the spectral reflectance R(λ) for the wavelength is likely to be significantly changed between the D65 light source and the F10 light source.

The coloring material used for adjusting the spectral reflectance R(λ) described above is preferably a coloring material containing at least one colorant (hereinafter also referred to as a color filter colorant) having a peak that is a maximum absorption wavelength peak of absorbance, for example, in a visible light range of 380 to 780 nm, that occupies a peak area greater than or equal to 50% of the integral value of a range of 380 to 780 nm, and that has a small half-width (preferably has a half-width of 70 nm or less).

Figure 3A:
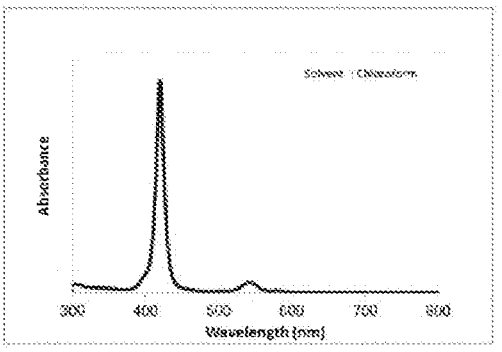
FIGS. 3A, 3B and 3C, respectively, show absorption spectra of coloring materials (FDB-001, FDG-005, and FDR-002 manufactured by Yamada Chemical Co., Ltd.) used in examples.
Figure 3B:
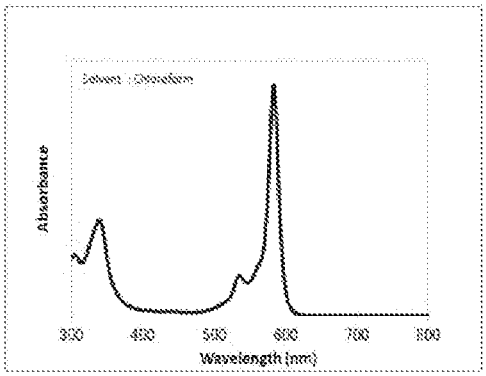
Figure 3C:
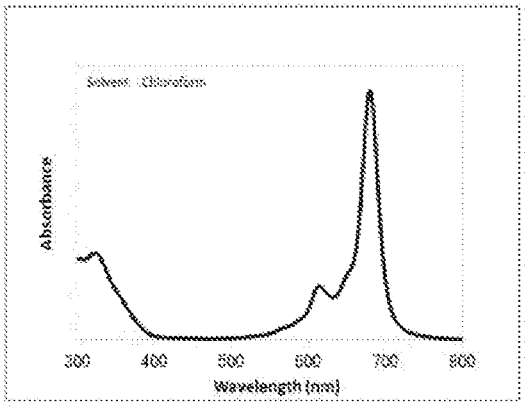
Figure 4A:
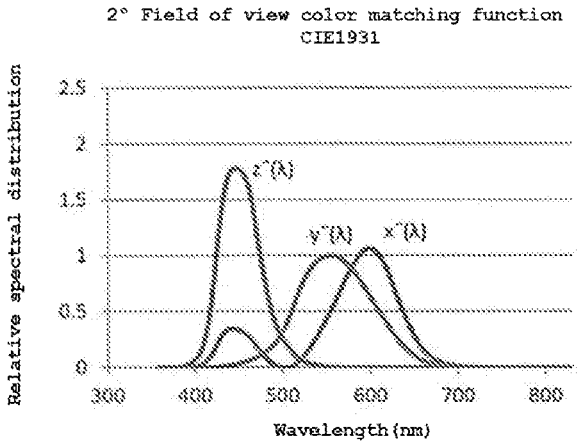
FIGS. 4A and 4B, respectively, show color matching functions (x(λ), y(λ), z(λ)) for a 2° field of view and a 10° field of view.
Figure 4B:
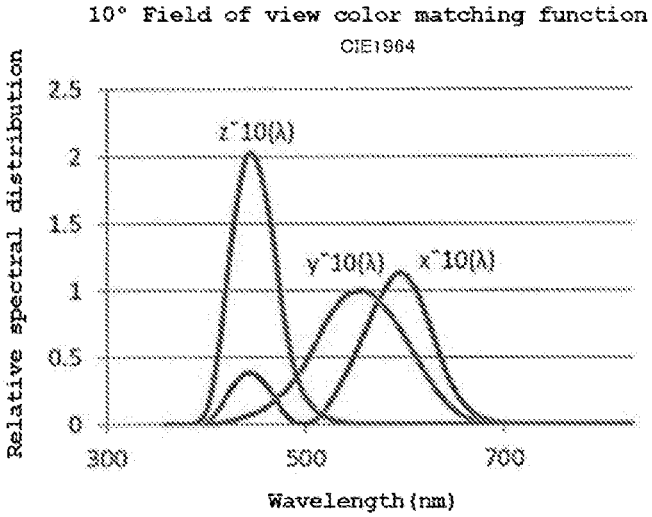
Figure 5A:
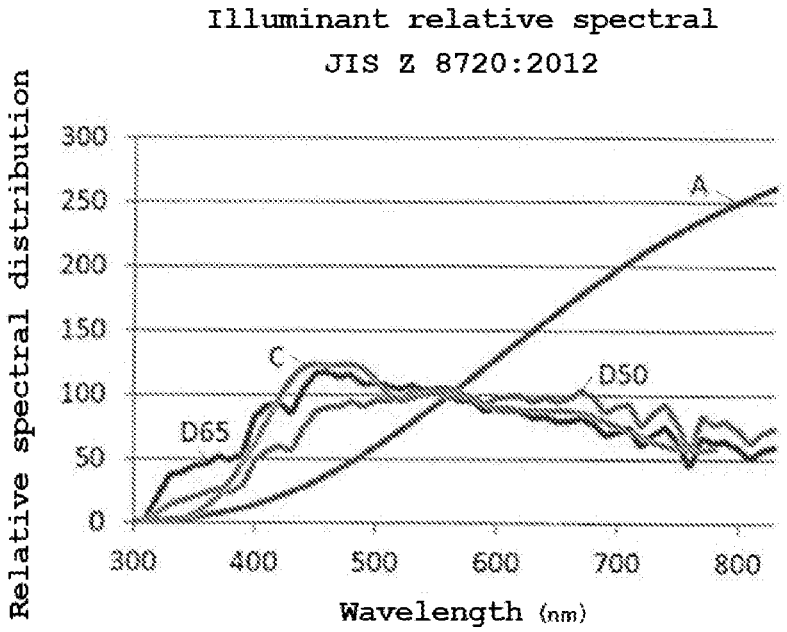
FIGS. 5A and 5B show spectral distributions S(λ) of standard light sources A and D65, and auxiliary light sources F6, F8, and F10, based on JIS Z 8720:2012 "Standard illuminants (standard light) and sources for colorimetry".
Figure 5B:
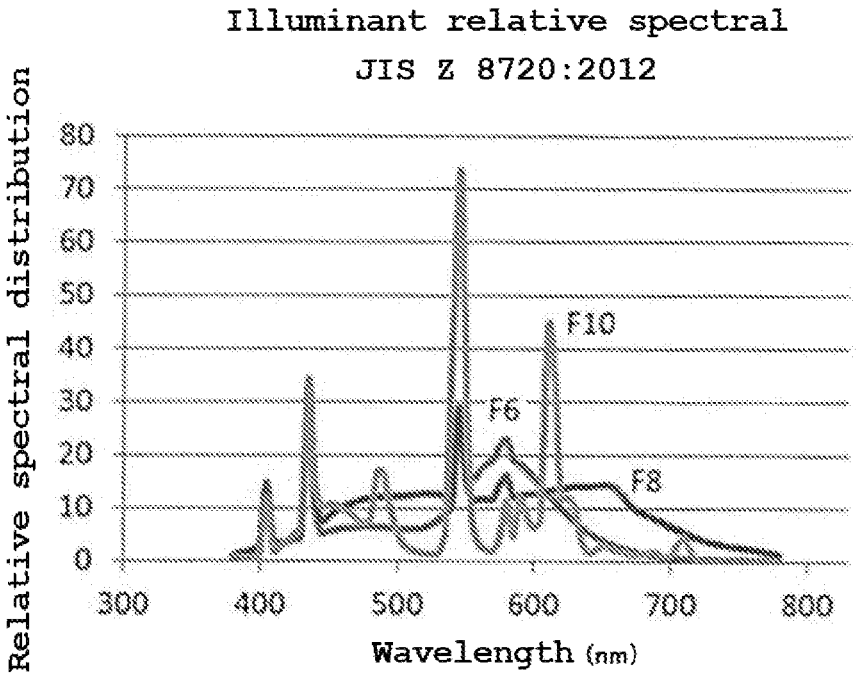

Specific examples of the color filter colorant include colorants that absorb blue light near a wavelength of 380 to 500 nm, such as FDB-001 (maximum absorption wavelength: 420 nm), FDB-002 (maximum absorption wavelength: 431 nm), FDB-003 (maximum absorption wavelength: 437 nm), FDB-004 (maximum absorption wavelength: 445 nm), FDB-005 (maximum absorption wavelength: 452 nm), FDB-006 (maximum absorption wavelength: 473 nm), and FDB-0017 (maximum absorption wavelength: 496 nm); colorants that absorb green light near a wavelength of 500 to 600 nm, such as FDG-001 (maximum absorption wavelength: 503 nm), FDG-002 (maximum absorption wavelength: 525 nm), FDG-003 (maximum absorption wavelength: 547 nm), FDG-004 (maximum absorption wavelength 578 nm), FDG-005 (maximum absorption wavelength 583 nm), FDG-006 (maximum absorption wavelength: 585 nm), and FDG-007 (maximum absorption wavelength: 594 nm); and colorants that absorb red light near a wavelength of 600 to 780 nm, such as FDR-001 (maximum absorption wavelength: 609 nm), FDR-002 (maximum absorption wavelength: 680 nm), FDR-003 (maximum absorption wavelength: 695 nm), FDR-004 (maximum absorption wavelength: 716 nm), and FDR-005 (maximum absorption wavelength: 725 nm), all of which are manufactured by Yamada Chemical Co., Ltd. As an example, FIGS. 3A, 3B and 3C, respectively, show absorbance spectra in chloroform of FDB-001, FDG-005, and FDR-002.

As long as a surface configured such that $L^*_{D65}$ is 30 to 95, and at least one selected from a condition $|\Delta C|=|C^*_{F10}-C^*_{D65}|\geq 7$, and a condition $|\Delta h°|=h_{F10}-h_{D65}|\geq 7°$ is satisfied can be obtained, an additional colorant other than the color filter colorant may be blended in the coloring material as needed.

The above-described color filter colorants and other colorants may be used alone or in a combination of two or more.

When the coloring material is blended in the resin layer, the blending ratio thereof is adjusted as appropriate according to the desired color, and the ratio to the resin contained in the resin layer is preferably 0.001 to 0.8, more preferably 0.005 to 0.6, and particularly preferably 0.01 to 0.5.

Hereinabove, a grain-finished artificial leather, which is a grain-finished leather-like sheet, has been described in detail as an example of the leather-like sheet according to the present invention. The leather-like sheet according to the present invention is not limited to a grain-finished leather-like sheet, and may be a suede-like or nubuck-like napped leather-like sheet formed by raising fibers on the surface of a fiber base material. In the case of a napped leather-like sheet, the napped surface constitutes a surface configured such that $L^*_{D65}$ is 30 to 95, and at least one selected from a condition $|\Delta C|=|C^*_{F10}-C_{D65}|\geq 7$, and a condition $|\Delta h°|=|h_{F10}-h_{D65}|\geq 7°$ is satisfied. Such a surface can be adjusted, for example, by fixing the above-described coloring material to a fiber base material using a binder such as an elastic polymer.

The leather-like sheet according to the present embodiment described above can be preferably used as a skin material for bags, clothing, shoes, and the like.

EXAMPLES

Hereinafter, the present invention will be described in further detail by way of examples. It should be appreciated that the scope of the invention is by no means limited to the examples.

First, colorants used in the present examples are summarized below.

FDB-001 (a color filter colorant having a maximum absorption wavelength of 420 nm and a half-width of 25 μm, color of solution: red, manufactured by Yamada Chemical Co., Ltd.)

FDG-005 (a color filter colorant having a maximum absorption wavelength of 583 nm and a half-width of 18 μm, color of solution: purple, manufactured by Yamada Chemical Co., Ltd.)

FDR-002 (a color filter colorant having a maximum absorption wavelength of 680 nm and a half-width of 27 μm, color of solution: blue, manufactured by Yamada Chemical Co., Ltd.)

PBk-7 (carbon black, manufactured by Dainichiseika Color & Chemicals Mfg. Co., Ltd.)

PY-73 (C.I. Pigment Yellow 73)

PY-42 (C.I. Pigment Yellow 42)

PY-3 (C.I. Pigment Yellow 3)

PG-7 (C.I. Pigment Green 7)

Evaluation methods used in the examples are summarized below.

<Colorimetry>

The reflection spectrum of the surface of a grain-finished artificial leather was measured using a spectrophotometer (U-3010, manufactured by Hitachi High-Technologies Corporation). Then, from the obtained reflection spectrum, the respective coordinate values in the L* a* b* color system of two types of light sources (D65, F10) at a viewing angle of 10° were calculated in accordance with JIS Z 8781. Then, the lightness Lk value ($L^*_{D65}$, $L^*_{F10}$), the chroma C* value ($C^*_{D65}$, $C^*_{F10}$) the hue angle h value ($h_{D65}$, $h_{F10}$) and $|\Delta C|$ $|\Delta h°|$, and $\Delta E_{CMC}(l=c=1)$, which are color difference components thereof, were obtained. Note that each of the values is an average of the values for three average positions evenly selected from the test piece.

<Visual Evaluation>

A test piece measuring 10 cm per side was cut out from the grain-finished artificial leather. Then, the test piece was visually observed under a D65 standard light source and under an F10 light source, which is a three-wavelength neutral white fluorescent lamp, in a standard light source box (GretagMacbeth SpetraLight III manufactured by X-lite), and the results were evaluated according to the following criteria.

Grade 3: The hue or the chroma significantly changed under the two light sources.

Grade 2: The hue or the chroma changed under the two light sources, to a degree that a difference therebetween was visible.

Grade 1: Substantially no change was observed.

Example 1

A fiber base material having a thickness of 0.6 mm was prepared by impregnating polyurethane into a non-woven fabric of PET-based filaments having a fineness of 0.08 decitex such that the mass ratio of polyurethane/filament was 12/88. Then, a grain-finished resin layer was stacked on the fiber base material in the manner described below.

A resin solution was prepared by dispersing, in 30 mass % of a polyurethane DMF/MEK (1:1) solution containing a non-yellowing polycarbonate-based polyurethane, a colorant obtained by mixing the colorants FDB-001, FDG-005, and FDR-002 at a ratio shown in Table 1. Note that the colorant was blended in the solid content of the resin solution such that the mass ratio of the colorant to the polyurethane is 0.1 to 1. The prepared resin solution for forming a polyurethane layer was applied onto release paper, and thereafter dried for 2 minutes at 120° C., thus forming a polyurethane skin layer having a thickness of 30 μm.

Next, the same polyurethane DMF/MEK (1:1) solution as the one described above was applied onto the surface of the skin polyurethane layer formed on the release paper, and thereafter dried for 2 minutes at 120° C., thus forming a film of a polyurethane intermediate layer having a thickness of 30 μm.

Then, a polyurethane solution for forming an adhesion layer was applied onto the surface of the film of the polyurethane layer formed on the release paper, in an amount corresponding to a dry thickness of 60 μm, and thereafter dried for 1 minute at 80° C. into a semi-dry state.

The thus formed adhesion layer in a semi-dry state on the release paper was placed in contact with the sliced surface of the fiber base material, and pressure-bonded thereto using a roll. Then, the whole was aged for 3 days at 50° C., and thereafter the release paper was released, whereby a blue-based grain-finished artificial leather was obtained.

Figure 6A:
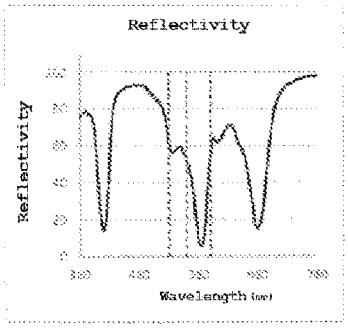
FIGS. 6A-6K, respectively, show spectral reflectances R(λ) of surfaces of grain-finished artificial leathers obtained in Examples 1 to 6 and Comparative Examples 1 to 5.
Figure 6B:
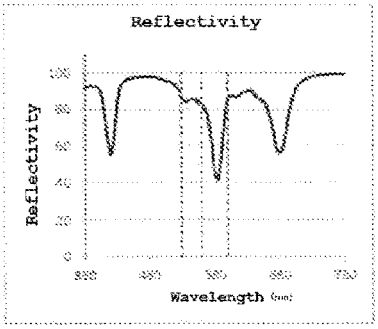
Figure 6C:
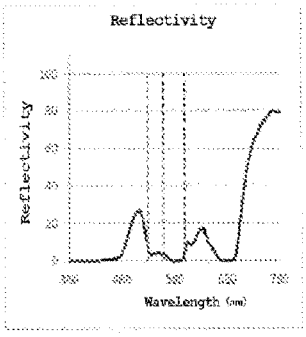
Figure 6D:
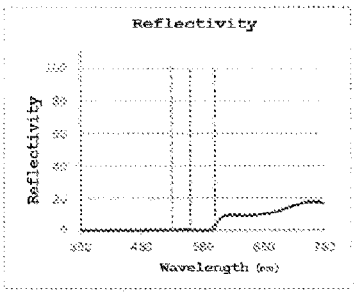
Figure 6E:
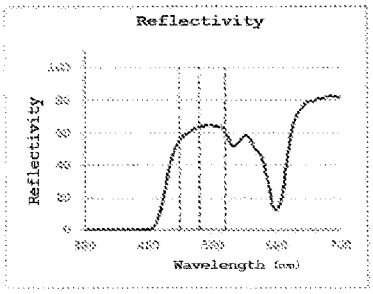
Figure 6F:
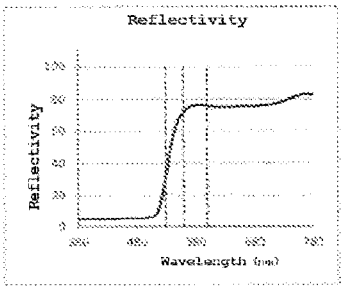
Figure 6G:
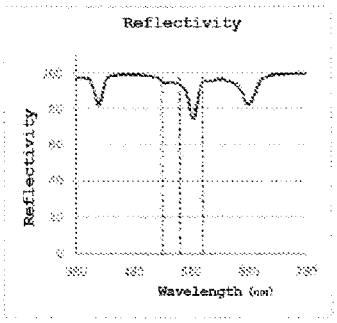
Figure 6H:
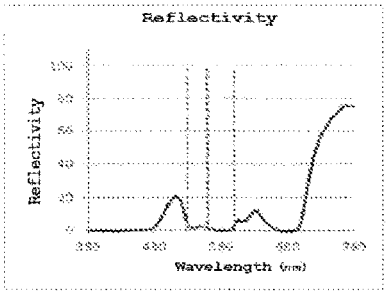
Figure 6I:
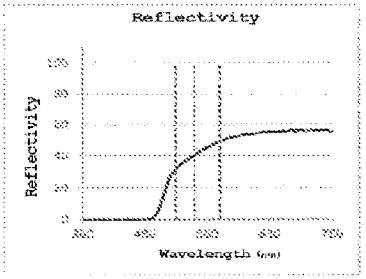
Figure 6J:
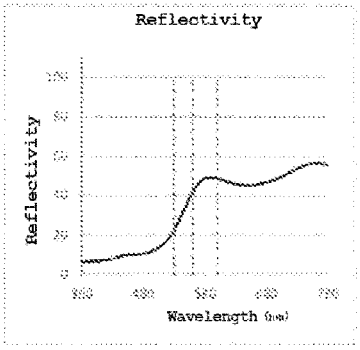

Then, the surface of the blue-based grain-finished artificial leather was evaluated by the above-described methods. The results are shown in Table 1 below. In addition, FIG. 6A shows the spectral reflectance R(λ) of the surface of the obtained grain-finished artificial leather.

Figure 6K:
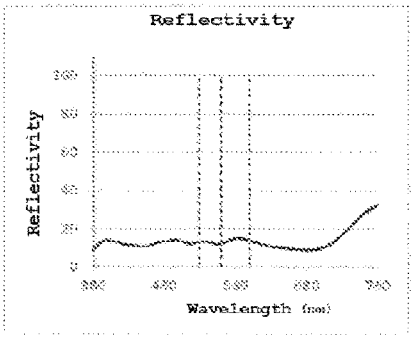

Thus, a dyed suede-like artificial leather was obtained. Then, the suede-like artificial leather was evaluated in the same manner as in Example 1. The results are shown in Table 1 and FIG. 6K.

(Dyeing Conditions)

Dye liquid:

Disperse Yellow 163 (disperse dye) 2.55% owf

Disperse Red 86 (disperse dye) 1.50% owf

Disperse BLUE 60 (disperse dye) 1.92% owf

"AL" (level dyeing agent) (manufactured by Nippon Kayaku Co., Ltd.) 2.0 g/dm$^3$ "New Buffer K" (pH regulator) (manufactured by Mitejima Chemical Co., Ltd.) 1.8 g/dm$^3$

TABLE 1

| Example No. | | Ex. 1 | Ex. 2 | Ex. 3 | Ex. 4 | Ex. 5 | Ex. 6 | Com. 1 | Com. Ex. 2 | Com. Ex. 3 | Com. Ex. 4 | Com. Ex. 5 |
|---|---|---|---|---|---|---|---|---|---|---|---|---|
| Composition (Mass ratio) | FDB-001 | 1 | 1 | 1 | — | — | — | 1 | 1 | — | — | (Suede-like artificial leather dyed with Disperse Y163 2.55% owf, Disperse R86 1.5% owf, Disperse B60 1.92% owf) |
| | FDG-005 | 1 | 1 | 1 | 3 | — | — | 1 | 1 | — | — | |
| | FDR-002 | 1 | 1 | 1 | — | 2 | — | 1 | 1 | — | — | |
| | PBk-7 (CB) | — | — | — | — | — | — | — | — | 0.1 | — | |
| | PY-73 | — | — | — | — | 3 | 4 | — | — | — | — | |
| | PY-42 | — | — | — | 5 | — | 1 | — | — | — | 1 | |
| | PY-3 | — | — | 0.1 | — | — | — | — | 0.1 | 5 | — | |
| | Mass Ratio (Colorant/ Polyurethane) | 0.1 | 0.05 | 0.4 | 0.15 | 0.1 | 0.1 | 0.02 | 0.5 | 0.1 | 0.1 | |
| (1-Rmax)/(1-Rmin) | | | | | | | | | | | | |
| 520-540 nm | | 0.46 | 0.42 | 0.80 | 0.94 | 0.85 | 0.53 | 0.40 | 0.84 | 0.87 | 0.87 | 0.99 |
| 550-570 nm | | 0.66 | 0.58 | 0.96 | 0.95 | 0.96 | 0.74 | 0.56 | 0.98 | 0.91 | 0.83 | 0.98 |
| 590-610 nm | | 0.41 | 0.28 | 0.90 | 0.60 | 0.80 | 0.96 | 0.24 | 0.94 | 0.93 | 0.97 | 0.98 |
| D65 | $L^*_{D65}$ | 81.06 | 92.90 | 33.40 | 39.23 | 60.38 | 76.34 | 97.43 | 27.09 | 64.67 | 64.09 | 42.70 |
| | $a^*_{D65}$ | −13.30 | −5.75 | −30.54 | 40.20 | −6.88 | 20.83 | −2.16 | −30.47 | 12.58 | 15.69 | −2.06 |
| | $b^*_{D65}$ | −17.63 | −6.60 | 30.85 | −0.80 | 97.00 | 83.30 | −2.39 | 28.66 | 103.57 | 46.66 | 3.04 |
| | $C^*_{D65}$ | 22.08 | 8.75 | 43.41 | 40.20 | 97.25 | 85.86 | 3.22 | 41.83 | 104.33 | 49.23 | 3.67 |
| | $h_{D65}$ | 232.97 | 228.96 | 134.71 | 358.86 | 94.06 | 75.96 | 227.96 | 136.76 | 83.08 | 71.42 | 124.11 |
| F10 | $L^*_{F10}$ | 80.89 | 93.24 | 28.53 | 42.46 | 62.64 | 75.96 | 97.60 | 21.45 | 67.15 | 65.54 | 42.65 |
| | $a^*_{F10}$ | −1.81 | −1.41 | −1.00 | 44.90 | −16.71 | 81.09 | −0.61 | −0.32 | 7.16 | 10.58 | −1.87 |
| | $b^*_{F10}$ | −20.06 | −7.23 | 26.60 | 4.87 | 103.43 | 5.81 | −2.58 | 23.23 | 110.83 | 49.47 | 3.43 |
| | $C^*_{F10}$ | 20.14 | 7.37 | 26.62 | 45.16 | 104.77 | 91.16 | 2.65 | 23.24 | 111.06 | 50.59 | 3.91 |
| | $h_{F10}$ | 264.84 | 258.97 | 92.15 | 6.18 | 99.18 | 91.35 | 256.80 | 90.79 | 86.31 | 77.92 | 118.52 |
| Color difference | \| ΔC \| | 1.93 | 1.39 | 16.79 | 4.96 | 7.53 | 5.48 | 0.57 | 18.59 | 6.74 | 1.37 | 0.23 |
| | \| Δh ° \| | 31.87 | 30.01 | 42.56 | 7.33 | 5.12 | 10.39 | 28.84 | 45.97 | 3.23 | 6.50 | 5.59 |
| | $\Delta E_{CMC}$ | 9.46 | 4.98 | 16.32 | 5.26 | 5.26 | 10.67 | 1.99 | 17.45 | 4.26 | 4.87 | 0.54 |
| Visual evaluation (grade) | | 3 | 2 | 2 | 2 | 2 | 3 | 1 | 1 | 1 | 1 | 1 |

Examples 2 to 6, Comparative Examples 1 to 4

Grain-finished artificial leathers were obtained and evaluated in the same manner as in Example 1 except that the blending composition of the colorant was changed as shown in Table 1. The results are shown in Table 1. In addition, FIGS. 6B-6J, respectively, show the spectral reflectances R(λ) of the surfaces of the obtained grain-finished artificial leathers.

Comparative Example 5

A suede-like artificial leather base fabric including a fiber base material having a thickness of 0.6 mm and a basis weight of 330 g/cm$^3$, and having a napped surface was prepared by impregnating polyurethane into a non-woven fabric of PET-based filaments having a fineness of 0.08 decitex such that the mass ratio of polyurethane/filament was 12/88. Then, the base fabric was scalded in hot water at 80° C. for 20 minutes to be well wetted with hot water and relaxed, and thereafter dyed in gray using a high-pressure jet dyeing machine (circular dyeing machine manufactured by HISAKA WORKS, LTD.) under the following conditions.

"H867" (metal ion deactivator) (manufactured by Ipposha Oil Industries Co., ltd.) 0.5 g/dm$^3$ Dyeing temperature: 120° C.

Dyeing time: 40 minutes

Bath ratio: 1:20

Referring to Table 1, the grain-finished artificial leathers obtained in Examples 1 to 6 according to the present invention, each of which had a surface configured such that $L^*_{D65}$ was 30 to 95, and at least one selected from a condition $|\Delta C|=C^*_{F10}-C^*_{D65}|\geq 7$, and a condition $|\Delta h°|=h_{F10}-h_{D65}|\geq 7°$ was satisfied, all were able to allow a person to perceive a change in hue or chroma in the visual evaluation. On the other hand, Comparative Example 1, in which $L^*_{D65}$ exceeded 95, Comparative Example 2, in which $L^*_{D65}$ was less than 30, and Comparative Examples 3 and 4, in which $|\Delta C|<7$ and $|\Delta h°|<7°$, all were not able to allow a person to perceive a change in hue and chroma in the visual evaluation.

For the suede-like artificial leather obtained in Comparative Example 5, $L^*_{D65}=42.70$, $|\Delta C|=0.23$, $|\Delta h°|=5.59°$, and $\Delta E_{CMC}=0.54$. Then, the suede-like artificial leather was not able to allow a person to perceive a change in hue and chroma in the visual evaluation. In addition, as a result of measuring the color difference between the D65 light source and the F6 light source, which was a light source exhibiting lower color rendering than the F10 light source, the values were $|\Delta C_{F6\text{-}D65}|=|C^*_{F6}-C^*_{D65}|=0.44$, $|\Delta h+_{F6\text{-}D65}|=|h_{F6}-h_{D65}|=28.35$, and $\Delta E_{CMC\ F6\text{-}D65}=2.48$.

REFERENCE SIGNS LIST

1. . . . Fiber base material
2. . . . Surface resin layer
10. . . . Grain-finished leather-like sheet

The invention claimed is:

1. A leather-like sheet comprising a surface configured such that, when an L* value, a C* value, and an h value under illumination of a D65 light source are represented as $L^*_{D65}$, $C^*_{D65}$, and $h_{D65}$, and an L* value, a C* value, an h value under illumination of an F10 light source are represented as $L^*_{F10}$, $C^*_{F10}$, and $h_{F10}$, $L^*_{D65}$ is 30 to 95, and at least one selected from a condition $|\Delta C|=|C^*_{F10}-C^*_{D65}|\geq 7$, and a condition $|\Delta h°|=|h_{F10}-h_{D65}|\geq 7°$ is satisfied.

2. The leather-like sheet according to claim 1, comprising the surface configured such that, when a maximum reflectivity of a spectral reflectance R(λ) in each of wavelength ranges of 520 to 540 nm, 550 to 570 nm, and 590 to 610 nm is represented as $R_{max}$, and a minimum reflectivity is represented as $R_{min}$, $$(1-R_{max})/(1-R_{min})<0.8$$

is satisfied in at least one of the wavelength regions.

3. The leather-like sheet according to claim 1, wherein the leather-like sheet is a grain-finished leather-like sheet including a surface resin layer, and the surface resin layer includes a color filter colorant having a peak that is a maximum absorption wavelength peak of absorbance in a visible light range of 380 to 780 nm, that occupies a peak area greater than or equal to 50% of an integral value of a range of 380 to 780 nm, and that has a half-width of 70 nm or less.

4. The leather-like sheet according to claim 1, wherein the leather-like sheet is a napped leather-like sheet including a fiber base material, and having a napped surface, the fiber base material includes a color filter colorant having a peak that is a maximum absorption wavelength peak of absorbance in a visible light range of 380 to 780 nm, that occupies a peak area greater than or equal to 50% of an integral value of a range of 380 to 780 nm, and that has a half-width of 70 nm or less.

5. The leather-like sheet according to claim 2, wherein the leather-like sheet is a grain-finished leather-like sheet including a surface resin layer, and the surface resin layer includes a color filter colorant having a peak that is a maximum absorption wavelength peak of absorbance in a visible light range of 380 to 780 nm, that occupies a peak area greater than or equal to 50% of an integral value of a range of 380 to 780 nm, and that has a half-width of 70 nm or less.

6. The leather-like sheet according to claim 2, wherein the leather-like sheet is a napped leather-like sheet including a fiber base material, and having a napped surface, the fiber base material includes a color filter colorant having a peak that is a maximum absorption wavelength peak of absorbance in a visible light range of 380 to 780 nm, that occupies a peak area greater than or equal to 50% of an integral value of a range of 380 to 780 nm, and that has a half-width of 70 nm or less.

* * * * *